US007416169B2

(12) United States Patent
Noeske et al.

(10) Patent No.: US 7,416,169 B2
(45) Date of Patent: Aug. 26, 2008

(54) HOISTING-CABLE DRIVE COMPRISING A SINGLE BOTTOM-HOOK BLOCK AND TWO WINCHES

(75) Inventors: Ingo Noeske, Zweibruecken (DE); Alfons Weckbecker, Zweibruecken (DE); Axel Beckmann, Saarbruecken (DE)

(73) Assignee: Terex Demag GmbH, Zweibruecken (DE)

( * ) Notice: Subject to any disclaimer, the term of this patent is extended or adjusted under 35 U.S.C. 154(b) by 0 days.

(21) Appl. No.: 11/659,402

(22) PCT Filed: Jul. 27, 2005

(86) PCT No.: PCT/EP2005/008157

§ 371 (c)(1),
(2), (4) Date: May 2, 2007

(87) PCT Pub. No.: WO2006/013053

PCT Pub. Date: Feb. 9, 2006

(65) Prior Publication Data

US 2007/0290182 A1 Dec. 20, 2007

Related U.S. Application Data

(60) Provisional application No. 60/598,091, filed on Aug. 2, 2004.

(51) Int. Cl.
*B66D 1/50* (2006.01)

(52) U.S. Cl. ..... 254/275; 254/286; 212/274

(58) Field of Classification Search ..... 254/278, 254/269, 270, 275, 286, 290; 212/274, 275
See application file for complete search history.

(56) References Cited

U.S. PATENT DOCUMENTS 5,189,605 A 2/1993 Zuehlke et al.

(Continued)

FOREIGN PATENT DOCUMENTS

DE 1916644 11/1970

(Continued)

OTHER PUBLICATIONS

International Search Report for PCT/EP2005/008157 dated Nov. 7, 2005 and Written Opinion of the International Searching Authority.

*Primary Examiner*—Emmanuel M Marcelo
(74) *Attorney, Agent, or Firm*—Simpson & Simpson, PLLC

(57) ABSTRACT

The invention proposes a hoisting-cable drive for a mobile crane, which hoisting-cable drive uses a single bottom-hook block (15) instead of a known double bottom-hook block. However, to prevent this single bottom-hook block (15) from tilting in the two cable lines (9, 10), for example due to possible variations in the elongation of the two cable drives, the hoisting-cable drive according to the invention comprises a kinematic force equilibrium device (17, 21), which can equalize such differences. To this effect, another embodiment of the hoisting-cable drive according to the invention uses a hoisting-cable load pickup (21) within each cable line arrangement so that the rotary speed of the winches (7, 8) can be varied, taking into account any load differences in the individual hoisting-cable lines (9, 10). Furthermore, the invention also proposes that the rotary speed of the winches (7, 8) be adjusted, taking into account the geometric winch states and crane states.

7 Claims, 8 Drawing Sheets

U.S. PATENT DOCUMENTS

| | | | | |
|---|---|---|---|---|
| 5,297,019 | A | 3/1994 | Zuehlke | |
| 5,314,082 | A * | 5/1994 | Konop | 212/274 |
| 5,377,296 | A | 12/1994 | Greenway et al. | |
| 5,579,931 | A | 12/1996 | Zuehlke et al. | |
| 6,460,711 | B1 * | 10/2002 | Kato et al. | 212/275 |
| 6,598,859 | B1 * | 7/2003 | Kureck et al. | 254/292 |
| 6,651,961 | B1 | 11/2003 | Meyer | |

FOREIGN PATENT DOCUMENTS

| | | |
|---|---|---|
| DE | 3404505 | 9/1985 |
| DE | 4130970 | 4/1992 |
| FR | 2081769 | 12/1971 |
| JP | 62186894 | 8/1987 |

* cited by examiner

HOISTING-CABLE DRIVE COMPRISING A SINGLE BOTTOM-HOOK BLOCK AND TWO WINCHES

CROSS-REFERENCE TO RELATED APPLICATIONS

This application is the National Stage of PCT International Application No. PCT/EP2005/008157, filed Jul. 27, 2005, which application published in English and is hereby incorporated by reference in its entirety; said international application claims priority from U.S. Provisional Patent Application No. 60/598,091, filed Aug. 2, 2004 which is incorporated by reference in its entirety.

TECHNICAL FIELD

The present invention generally relates to the technical and constructional design of a hoisting-cable drive for a crane, and in particular a hoisting-cable drive comprising at least two hoisting winches, which hoisting-cable drive is suitable for raising or lowering a single bottom-hook block by means of two mechanically non-synchronised separate hoisting-cable winches without there being any danger synchronised or of tilting. Furthermore, the invention relates to a mobile crane equipped with the hoisting-cable drive according to the invention.

Furthermore, the present invention relates to a winch control system for a cable drive, comprising at least two mechanically non-synchronised hoisting winches, which winch control system is suitable for operating the cable drive such that the two sheave sets which form part of the cable drive do not tilt in relation to each other for example as a result of different elongation of the individual cable lines.

Furthermore, the invention relates to a synchronisation method for the hoisting-cable drive of a crane, comprising two hoisting winches, with which synchronisation method it is possible to operate the two hoisting winches such that the bottom-hook block of the crane does not tilt in relation to the sheave set arranged on the boom head of the crane, for example as a result of different elongation of the individual cable lines.

BACKGROUND TO THE INVENTION

Due to the ever advancing technical development of modern cranes, and in particular due to developments in the mobile crane sector, which in the context of the present invention includes in particular mobile telescopic cranes and mobile crawler cranes with braced mast booms, so-called lattice boom cranes, both the load capacities and the dimensions of the cranes, in particular the boom lengths of mobile cranes, are increasing significantly. However, this primarily positive development in crane design results in the cable drives that are necessary for hoisting operations of the cranes meeting their technical limits with increased frequency.

Due to the ever increasing carrying capacity of cranes, the tensile forces which a hoisting cable has to withstand are clearly increasing. In the case of unchanged materials characteristics this often leads to an increase in the cable diameter. As a rule this is also associated with a further increase in the diameter of the cable drums or the hoisting winches. Furthermore, due to the ever increasing dimensions of the cranes, in particular of the boom lengths, the cable lengths that have to be stored on the cable drum also increase, which also results in increasing winch diameters or cable drum diameters. These ever increasing winch diameters or cable drum diameters in turn require ever increasing driving torques of the winches; driving torques which at times can now hardly be generated with the usual drive units.

In order to satisfy the need for ever increasing sizes of winch drums or cable drums and the associated increase in driving torques, the use of a so-called double bottom-hook block as shown in FIG. 1 is known. In contrast to a single bottom-hook block, such a double bottom-hook block comprises two separate sheave sets, each of which is a component of two separate cable drives, wherein each cable drive is operated by a separate winch. In order to prevent the double bottom-hook block from assuming an inclined position, for example as a result of unequal cable elongation in the individual cable drives or as a result of not completely accurate synchronous operation of the winches, in other words to prevent the individual cable lines of a cable drive with a double bottom-hook block from being subjected to different loads, such a double bottom-hook block comprises a mechanical load equalisation which couples the two separate sheave sets such that different elongation in the cables or not completely accurate synchronous operation of the cable winches can be compensated for.

However, such double bottom-hook blocks with mechanical load equalisation often prove disadvantageous because, as a result of the increased design height due to the mechanical load equalisation, they directly result in a loss of hoisting height. Furthermore, double bottom-hook blocks always comprise multiple joints, which in particular during slinging and putting down cause problems so that such double bottom-hook blocks overall are relatively unwieldy. Because double bottom-hook blocks have to provide load equalisation for very considerable forces, namely for the sum of the forces from several hoisting-cable lines, these double bottom-hook blocks are often very solid and extremely difficult to handle.

Another known approach to the problem of synchronising two separate winches for the hoisting-cable drive of a crane provides for the two winches to be synchronised directly mechanically, for example by means of a toothed wheel arrangement. It is also known to continuously monitor the angular velocity of two separate hoisting winches and to equalise any difference in speed by changing the angular velocity of at least one of the two winches. Since it is not possible—either by means of mechanical synchronisation or by means of monitoring the angular velocity of the hoisting winches—for example to take into account different cable elongation in the two hoisting-cable lines, this approach to synchronising two hoisting winches is also unsatisfactory. Furthermore, in these synchronisation methods it is not possible to take into account the influence that the cable layer at the time has on the respective cable drum, or to take into account other geometric influences such as for example small differences in the diameters of the cables. Accordingly, cable drives that are operated by means of such known synchronisation methods often have a tendency to stress the individual cable lines unevenly, which at times in extreme cases can lead to overloading.

In U.S. Pat. No. 5,579,931 A an improved method and system for a liftcrane in which a load is lifted through the combined action of first and second hoist drums are disclosed. The known method and system use a first rope wound on one hoist drum and a second rope wound on the second hoist drum. The ends of the ropes opposite the hoist drums are linked together to transmit tension between them. The load is coupled to the ropes. If the take up speed of one of the ropes exceeds the take up speed of the other, the linked ends of the ropes will shift. This condition is detected and the operation of at least one of the first and second hoist drums is modified to bring the take up rates into balance. This system is advantageously used with a hoist block sheave arrangement. This system can also be used with a single rope in which each of the ends of the single rope are wound on a separate one of the hoist drums and the load is coupled to the middle of the rope.

U.S. Pat. No. 6,651,961 B1 discloses a multi-block rigging system for a heavy crane, pulling or lifting device. The system uses sheave blocks in series orientation to enable the use of standard, economical or preferred, size winch drums and standard, economical or preferred, diameter and length wire rope, each forming a separate set of reeving lines. Each set of reeving lines moves its corresponding load block a proportional distance of the total travel length for the load hook. Alternatively, different line parts of line for each reeved set enables different travel speeds of the load block for different capacity requirements.

In DE 34 04 505 A1 a length compensation between two ropes in a rope drive, in particular for cranes, is disclosed. Here, the free ends of two ropes are in each case attached to two jokes, from which at least two rope sections are passed over compensating pulleys, the two rope sections consisting of a right-hand and a left-hand wire rope.

DE 41 30 970 A1 corresponding to U.S. Pat. No. 5,377,296 A discloses a control system for an electric motor arranged to drive a rope drum of a mine winder or a hoist system which includes a conveyance supported by a rope and which forms an oscillating system. The known control system includes a load sensor which monitors the load in the rope and a rope length sensor which monitors the length of rope paid out from the rope drum. A motor control unit is responsive to signals from the sensors and calculates set points for speed, acceleration and jerk of the oscillating system. The control unit generates a control signal which is related to a natural oscillation mode of the oscillating system so as to prevent the excitation of oscillations in the system, and controls a motor drive in accordance with the control signal.

A further control and hydraulic system for liftcrane is known from EP 0 422 821 B1 corresponding to U.S. Pat. Nos. 5,189,605 A, 5,297,019 A, and 5,579,931 A. This known lift crane includes controls by which an operator can run the lift crane and mechanical subsystems each powered by a closed loop hydraulic system having a pump and an actuator. According to this known system a controller responsive to the controls and connected to the mechanical subsystems is provided, and further the controller is capable of running a routine for controlling said mechanical subsystems to define operation of the lift crane.

SUMMARY OF THE INVENTION

It is thus an object of the present invention to provide a hoisting-cable drive which is not associated with the previously described disadvantages of a double bottom-hook block, and which is also not subjected to the previously described effects of the synchronisation methods briefly mentioned above, which synchronisation methods relate to two separate hoisting winches.

According to a first aspect of the present invention, this object is met by a hoisting-cable drive for a mobile crane which does not comprise a previously described double bottom-hook block of complex construction, but instead comprises a single bottom-hook block which comprises a sheave set that has at least two pulleys. Furthermore, the hoisting-cable drive according to the invention comprises a sheave set, arranged on the boom head of the mobile crane, which sheave set also comprises at least two pulleys, two mechanically non-synchronised hoisting winches, two separate hoisting-cable lines and a kinematic force equilibrium device that is arranged on the boom head or on the bottom-hook block. In this arrangement, starting from one of the two hoisting winches, each of the two hoisting-cable lines is reeved to the single bottom-hook block by way of one of the pulleys, of which there are at least two, arranged on the boom head, from where it leads to the force equilibrium device. The kinematic force equilibrium device arranged on the boom head or on the single bottom-hook block is advantageous in that as a result of its kinematic design it equalises any possibly existing different tensile forces in the two cable lines, which different tensile forces can for example arise as a result of different cable elongation or incorrect synchronisation of the hoisting winches.

In contrast to a known double bottom-hook block, it is thus not necessary for the two separate sheave sets of the double bottom-hook block to comprise a complex mechanical load equalisation device which, as already mentioned above, is very solid and difficult to handle. Instead, the kinematic force equilibrium device according to the invention, which device can also be detachably attached as a separate device to the boom head or to the single bottom-hook block, makes possible the use of a single bottom-hook block which due to its simple design is less solid and thus easier to handle than a comparable double bottom-hook block. Since due to the kinematic force equilibrium device it is thus no longer necessary to use a double bottom-hook block to provide load equalisation, the previously described disadvantages of a double bottom-hook block can be avoided.

According to an exemplary embodiment of the hoisting-cable drive according to the invention, the kinematic force equilibrium device is an equalising swivel which is hinged to the boom head or to the single bottom-hook block. This equalising swivel is designed as a lever mechanism, wherein the rotary joint of the lever is connected to the boom head or to the single bottom-hook block.

According to a further aspect of the present invention, the ends of the two hoisting-cable lines are attached to the two opposing legs of the equalising swivel. This arrangement preferably provides for the two ends of the two hoisting-cable lines to be attached to the respective ends of the opposing legs of the equalising swivel at the same distance from the hinged joint of the lever mechanism. However, it is of course also possible to deliberately attach the ends of the two hoisting-cable lines at a different distance from the fulcrum of the lever mechanism, for example to counter different geometric or kinematic relationships or different force relationships in the respective hoisting-cable lines, such as for example different sheave diameters or different cable line arrangements, for example due to different cable types and/or winches.

By arranging the hoisting-cable drive according to the invention with a kinematic force equilibrium device, for example in the form of a hinged equalising swivel, equalisation of different cable elongation or equalisation of incorrect synchronisation of the two hoisting winches can be achieved. For example, in that one cable line of the hoisting-cable drive is elongated more than the other cable line, this will lead to the equalising swivel adjusting itself according to the different cable elongation until the forces in both hoisting-cable drives are the same again.

In order to prevent excessive twisting of the equalising swivel due to ever increasing different cable elongation or due to incorrect synchronisation of the two hoisting winches, according to a further aspect of the present invention the hoisting-cable drive according to the invention comprises a registering device, for example a limit switch or a winch control system that will be explained in more detail below, wherein said registering device monitors the kinematic change in the state of the force equilibrium device and controls the rotary speed of the winch or winches accordingly.

As already mentioned, the registering device can be a simple limit switch which detects a maximum permissible kinematic change in the state of the force equilibrium device, such as for example a maximum permissible twisting, and transmits this information to the winch synchronisation control system.

According to a further aspect of the hoisting-cable drive according to the invention, said hoisting-cable drive comprises a winch synchronisation control system which, for example by processing the signals of the limit switch or generally by processing the registered kinematic change in state, adjusts the rotary speed of at least one of the two hoisting winches so that the length of both cable lines between the boom head and the single bottom-hook block is essentially always kept the same. Providing the hoisting-cable drive with a registering device and with a winch synchronisation control system is thus advantageous in that, in contrast to the known solution comprising a double bottom-hook block, wherein there is no longer a danger that due to excessively different elongation of one cable line the bottom-hook block twists excessively, which can lead to overload of the other cable line.

According to a further exemplary embodiment of the hoisting-cable drive, the kinematic force equilibrium device is an equalising roller by way of which one of the two hoisting-cable drives is deflected and conveyed to the other hoisting-cable drive. While this equalising roller involves a different design of the kinematic force equilibrium device, the design is based on the previously explained lever principle, since, as is known, such an equalising roller is comparable to a lever mechanism with corresponding lever arm length.

In the described embodiment using an equalising roller it is however possible, instead of using two completely separate hoisting-cable lines that can be rolled up on a separate hoisting winch each, to use only a single cable so that the two hoisting-cable lines are actually formed by a single cable. This embodiment actually involving a single cable is advantageous in that in this embodiment there is no limit state that must not be exceeded.

Of course it is also possible to provide the two hoisting-cable lines by means of two separate hoisting cables which at a joint are connected so as to be resistant to tension. However, since such a joint of two hoisting cables as a rule comprises larger dimensions or diameters than the respective cables themselves, it is normally not permitted to let this joint travel past the equalising roller due to different elongation behaviour of one of the two cables or due to incorrect synchronisation of one of the two hoisting winches. In order to prevent this from happening, the hoisting-cable drive comprises a registering device which monitors the relative position of the joint in relation to the equalising roller. If the joint between the two separate hoisting cables of the equalising roller comes within close proximity of the equalising roller, the registering device transmits a control signal to the winch synchronisation control system which then by processing this control signal adjusts the rotary speed of at least one of the two hoisting winches so that the joint moves away from the equalising roller.

Furthermore, it is possible to equip the hoisting-cable drive with a winch synchronisation control system which by processing the continuously registered kinematic change in state, which also includes registering the joint between the two separate hoisting cables, continuously adjusts the rotary speed of at least one of the two hoisting winches such that the length of both cable lines between the boom head and the single bottom-hook block is always essentially the same.

The two described exemplary embodiments using an equalising swivel or an equalising roller, for example integrated in the roller set on the boom head, thus prove advantageous in that it is possible, by a simple redesigning measure, even without reconstruction measures, to counter the disadvantages of a double bottom-hook block, in that, instead of using such an unwieldy double bottom-hook block, a single bottom-hook block that is easy to handle can be used for a hoisting-cable drive with two hoisting winches.

According to a further exemplary embodiment of the present invention a hoisting-cable drive comprising two controllable hoisting winches is provided, which hoisting-cable drive can also be operated with a single bottom-hook block with a sheave set comprising at least two pulleys, wherein said sheave set just like the previous embodiment is a sheave set arranged on the boom head of the mobile crane, which sheave set comprises at least two pulleys, wherein two separate hoisting-cable lines are wound onto the two separate hoisting winches, which hoisting-cable lines are reeved to the single bottom-hook block, starting from one of the two hoisting winches, by way of one of the pulleys, of which there are at least two arranged on the boom head. In order to equalise any load differences that may be present between the two hoisting-cable lines, the hoisting-cable drive according to the invention comprises a hoisting-cable load pickup at least within each hoisting-cable line arrangement, wherein said hoisting-cable load pickup detects any load differences present between the two cable lines so that such a load difference can be equalised by way of adjustment of the rotary speed of the two hoisting winches.

Due to the adjustment of the rotary speed of one of the two hoisting winches it is thus possible to equalise any existing load differences between the two cable lines, which differences can occur for example as a result of different elongation of the cables, by way of simple control of the rotary speed of one of the two winches so that it is no longer necessary to provide a double bottom-hook block for the purpose of load equalisation, which double bottom-hook blocks, as has been described above, are associated with a multitude of disadvantages.

According to a further aspect of the embodiment of the hoisting-cable drive with at least one load pickup within each cable line arrangement, the two hoisting-cable load pickups directly measure the tensile force in the respective cable lines. This can for example take place in that the two hoisting-cable load pickups are arranged on the respective ends of the two hoisting-cable lines so that the two ends of the two hoisting-cable lines are attached to the boom head or to the single bottom-hook block by way of a hoisting-cable load pickup.

Instead of measuring the tensile forces in the respective hoisting-cable lines directly, it is of course also possible to measure the tensile force in both cable lines indirectly, for example by way of determining the deflection force or bearing force at a deflection position of the respective cable lines. This can for example be achieved in that for registering the respective deflection force the two hoisting-cable load pickups are arranged on the sheave set arranged on the boom head.

According to a further exemplary embodiment of the hoisting-cable drive according to the invention, said hoisting-cable drive can comprise a sheave set with at least two pulleys; and can further comprise a sheave set arranged on the boom head of the mobile crane, which sheave set also comprises two pulleys; two mechanically non-synchronised hoisting winches; two separate hoisting-cable lines which are reeved to the single bottom-hook block, starting from one of the two hoisting winches by way of one of the pulleys, of which there are at least two, arranged on the boom head; as well as a winch control system which, by registering and processing the geometric winch states and equipment states of the mobile crane, adjusts the rotary speed of at least one of the two hoisting winches in such a way that the length of the two cable lines between the boom head and the single bottom-hook block is always essentially the same. Any references to geometric winch states in the context of the present invention refer for example to the current cable layer, the coiling diameter of the current cable layer, or for example to the winch rotations completed since a starting state, as well as to other influences and dimensions which may have an influence on synchronous operation.

According to a particular aspect of this embodiment of the hoisting-cable drive, it is thus provided for the winch control system to adjust the rotary speed of at least one of the two hoisting winches by registering and processing at least the present cable layer and/or the winch rotations that have already been carried out. In contrast to known synchronisation methods for two hoisting winches, which methods usually only keep the angular velocity or rotational speed of the two winches constant, which however due to different cable layers in both hoisting winches can result in different cable speeds, with the use of the proposed winch control system it is possible to also register the influences of different cable layers of both hoisting winches and thus to achieve exact synchronous operation of both hoisting winches, in particular as far as the two cable speeds are concerned.

According to a further aspect of the present invention, a winch control system for operating a cable, such as for example the hoisting-cable drive of a mobile crane, is provided, which hoisting-cable drive comprises a first and a second sheave set, at least two mechanically non-synchronised hoisting winches and at least two separate cable lines, which, starting from one of the two hoisting winches, are reeved to the second sheave set by way of the first sheave set, wherein the winch control system comprises:

- at least one registering device which during operation of the cable drive registers varying force states in the individual cable lines and/or the geometric winch states, equipment states or crane states of the mobile crane;
- a processing device which processes the state variables, in particular which compares said state variables with each other and puts them in proportion; and
- a control device which, depending on the processing results, adjusts the rotary speed of at least one of the hoisting winches such that the length of the cable lines, of which there are at least two, between the two sheave sets of the cable drive is essentially always the same.

According to a particular aspect of the invention, the registering device of the winch control system according to the invention comprises at least one load pickup within each cable line arrangement, which load pickup has already been described above in the context of the design of a cable drive with at least one hoisting-cable load pickup within each cable line arrangement, wherein at this point reference is made to the above position. As already described in said position, the load pickup is suitable for directly measuring the tensile forces present in the cable lines, of which there are at least two. To this effect the registering device can for example comprise at least two load cells, of which one in turn is arranged within each cable line arrangement. As also already mentioned above, it is however also possible for the load pickups to determine the force in the cable lines, of which there are at least two, indirectly by determining the deflection forces or the bearing forces at a deflection position of the respective cable line.

According to a further aspect of the invention, as an alternative the registering device can also register at least the respective current cable layer and/or the revolutions that each of the hoisting winches, of which there are at least two, has already carried out, as already described above.

The winch control system has proven advantageous in particular in that in the case of recording the current cable layer and/or the winch revolutions already carried out there is no need to make design changes to the cable drive itself, and in the case of registering the tensile forces by means of load pickups, only minor design changes to the cable drive itself are needed. In particular there is no need to use a double bottom-hook block, with the associated disadvantages as described above, for operating two hoisting winches.

According to a still further aspect of the present invention, a synchronisation method for the hoisting-cable drive of a crane is provided, which hoisting-cable drive comprises a single bottom-hook block with a sheave set comprising at least two pulleys; and further comprises a sheave set arranged on the boom head of the crane, which sheave set also comprises at least two pulleys; two controllable hoisting winches; two separate hoisting-cable lines which are reeved in, starting from one of the two hoisting winches by way of one of the pulleys, of which there are at least two, arranged on the boom head; wherein the method comprises the following steps:

- registering the varying force states in the individual hoisting-cable lines and/or registering the geometric winch states, equipment states or crane states during operation of the hoisting cable drive;
- processing the registered state variables;
- adapting the rotary speed of at least one of the hoisting winches depending on the processing results so that the length of the hoisting-cable lines, of which there are at least two, between the boom head and the single bottom-hook block of the cable drive is always essentially the same or is kept the same.

Of course it is advantageous if the synchronisation method is implemented with the use of the previously described winch control system. As has been described in the respective position explaining the winch control system, it is advantageous if the varying force states during operation of the hoisting-cable drive are registered in that the tensile force in the two hoisting-cable lines, of which there are at least two, is registered directly by means of a load pickup, such as for example a load cell.

As an alternative to the above it is of course again also possible to register the force states that vary during operation of the hoisting-cable drive in that the tensile force in the two hoisting-cable lines, of which there are at least two, is measured indirectly by determining the deflection force or the bearing force in a deflection position of the respective cable line.

According to a further aspect of the synchronisation method it is also possible to adjust the rotary speed of the winch by registering and processing the geometric winch states and equipment states of the crane, wherein registering the geometric winch states and equipment states of the crane can take place in that at least the respective current cable layer and/or the winch revolutions already carried out, which winch resolutions are counted starting from an initial state, with such registering taking place for each of the hoisting winches, of which there are at least two.

Generally, according to the present invention, a continuous detection of the actuating variable allows a continuous control of the winder speed of the winches. Contrary to the prior art showing the detection of stop positions or end positions the invention as disclosed provides a solution by which during the lifting of a load dynamic appearing compulsory can be effectively limited.

Furthermore, according to the invention, the controlled characteristic of the hoisting-cable drive can be adjusted and, in particular, the controlled characteristic of each winch can be adjusted in a wide range and in small increments.

In addition, the general method and device according to the invention generally enable the use of identical or non-identical winches with identical or different diameters and/or identical or different manufacturing tolerances, unequal rope length, unequal rope diameter and identical or different rope reevings in a hoisting-cable drive.

Generally, a length detection device as for example used in an inventive system, enables to measure the absolute position of the connecting point (also referred to as joint) of both hoisting-cable lines. In accordance with the invention, a predefined, but also variable reference position exists for this connecting point. The reference position and the actual position refer to a predefined center of reference. The center of reference can be a position at the crane, or at a part of the crane, and/or a point or position outside the crane, for example at a building, a tower, a position on the ground, or in the sky, for example given by satellites used for GPS navigation. In particular, according to the invention, the deviation of the actual position of the connecting point of the two cable lines in relation to the reference position of the connecting point may be measured by using the known GPS-navigation system or another known method for continuously measuring the deviation of the joint from the reference position.

In a preferred embodiment of the invention the length difference between the actual position and the reference position of the joint of the two cable lines is considered as an actuating variable at the control of the different rotational speeds of the two winches. From the rotational speed of the first winch results an associated rotational speed of the second winch due to ensure that the reference position of the joint does not change.

The measuring of the distance of the deviation of the actual position of the connecting point from the reference position may take place by a direct, continuous detection and is considered in the control of the rotational speeds of the winches.

In a further exemplary embodiment of the invention a maximum actuating variable may be used to avoid a condition which is critical with regard to safety. Such a situation which is critical with respect to safety may be given in the case that the connecting point enters into the sheave sets of a head or the bottom-hook block of a crane.

BRIEF DESCRIPTION OF THE DRAWINGS

Below, for an improved understanding and for further explanation of the present invention, a known double bottom-hook block and several embodiments of the present invention are described in more detail with reference to the enclosed drawings.

In all figures, identical parts are designated by corresponding or essentially similar reference characters.

DESCRIPTION OF THE EXEMPLARY EMBODIMENTS OF THE INVENTION

Figure 1:
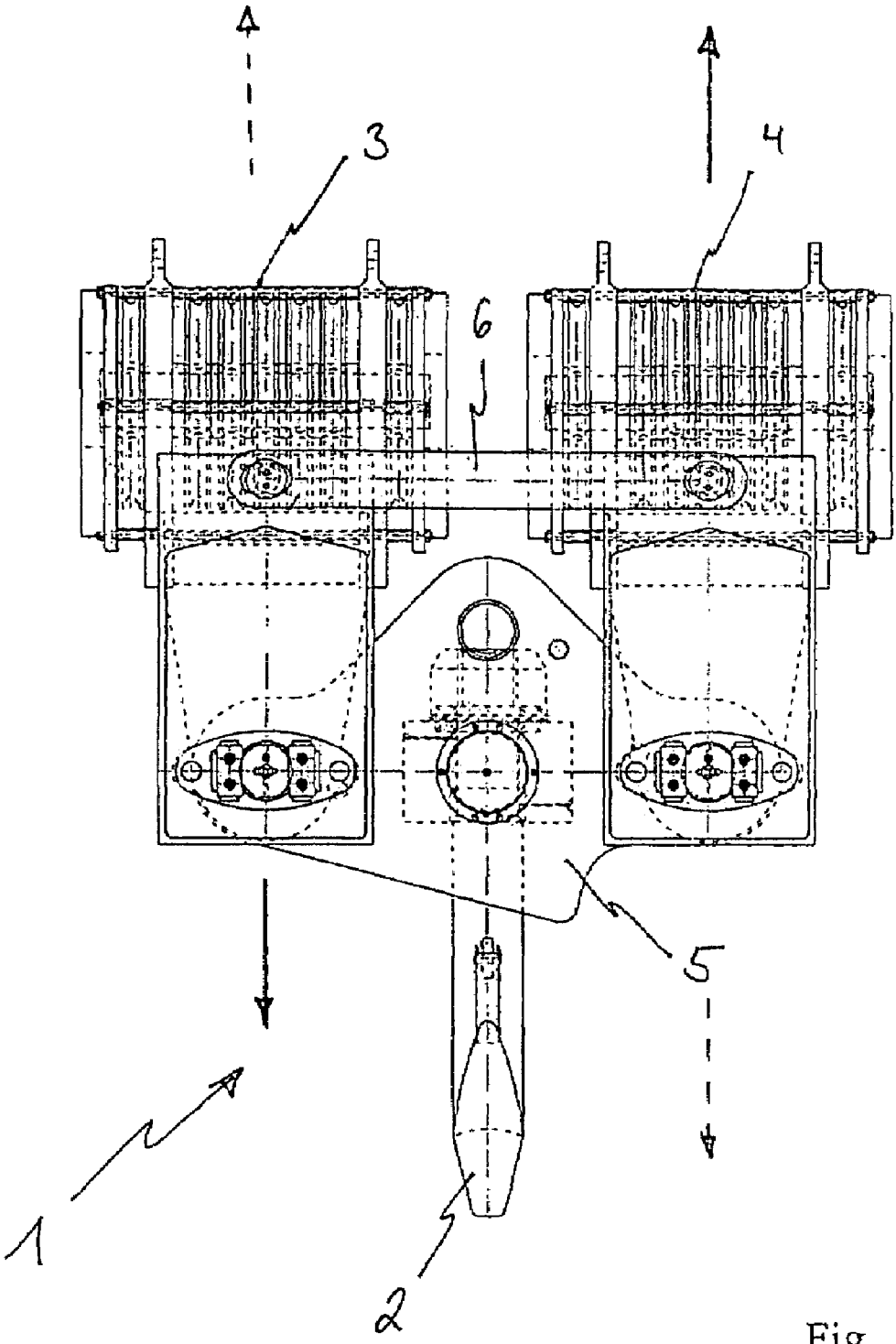
Fig. 1 PRIOR ART
FIG. 1 shows a front view of a known double bottom-hook block.

FIG. 1 shows a front view of a known double bottom-hook block 1. The double bottom-hook block 1, which is a snatch block comprising a hook 2, essentially comprises two sheave sets 2, 4, each of which in turn comprises several pulleys. The two sheave sets 3, 4 are mutually connected, so as to hinge, to two pairs of cross arms 5, 6 such that the two sheave sets 3, 4 are in a position to slide relative and parallel to each other in their mutual height position, as indicated by the arrows. As shown in FIG. 1, the construction of such a double bottom-hook block 1 is very complex. Due to the considerable loads that have to be transmitted by the cross arms 6, 5, said cross arms 6, 5 have to be designed so as to be very resistant, as shown in the diagram in particular by the solid design of the lower cross arm 5, thus resulting in enormous component dimensions and thus in considerable overall size of the double bottom-hook block. However, such an enormous design height of the double bottom-hook block reduces the attainable hoisting height of a crane, which is disadvantageous in particular in extreme situations. Furthermore, the diagram shows that the hinged connection between the upper cross arm 6 and the two sheave sets 3, 4 restricts free access of the sheaves, which often leads to problems during reeving of the cables to the sheave sets 3, 4. Finally, the entire construction of the shown double bottom-hook block 1 is relatively expensive, unwieldy and massive and in particular in the often encountered harsh conditions on building sites tends to be susceptible to malfunctions and breakdowns.

Figure 2:
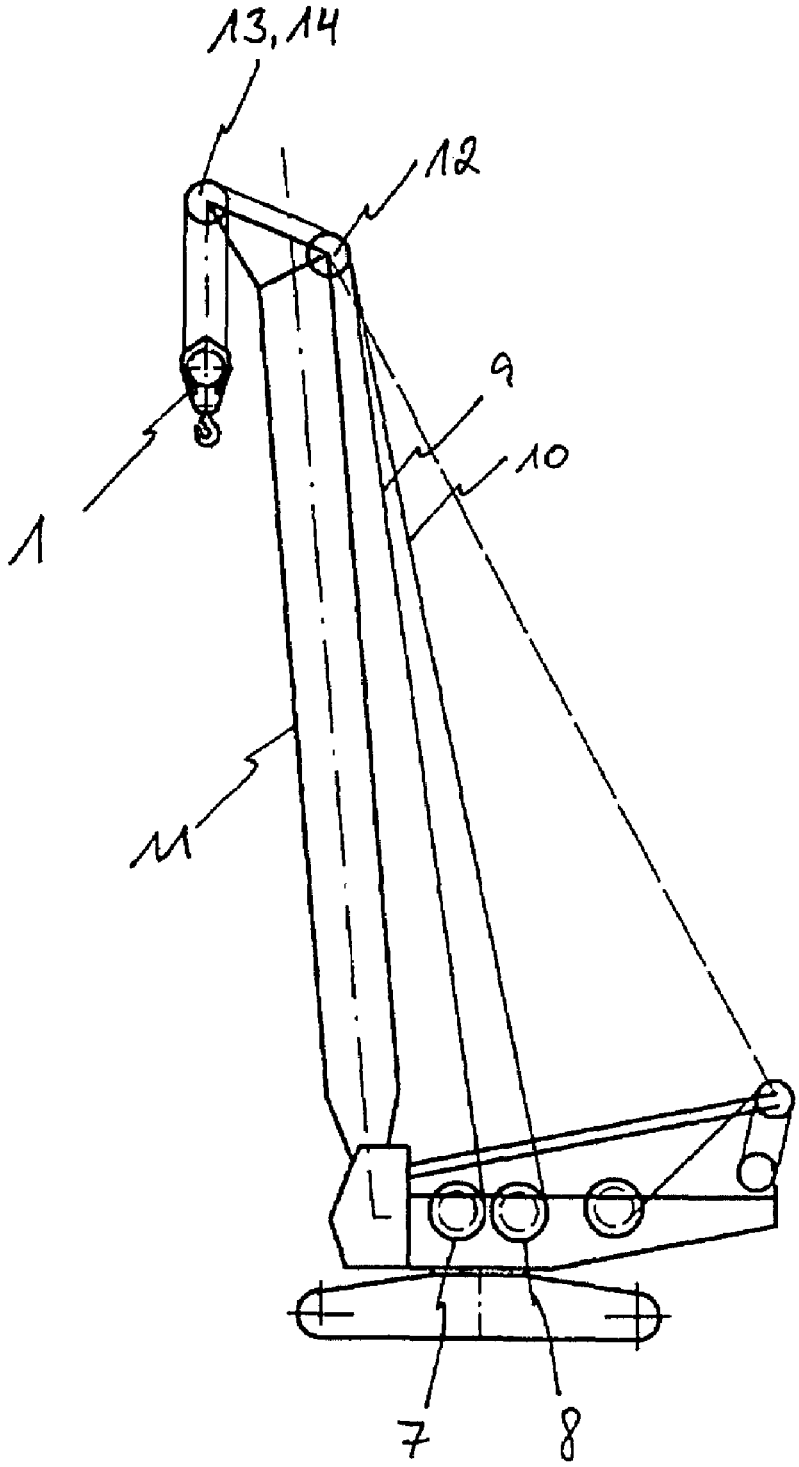
Fig. 2 PRIOR ART
FIG. 2 shows a side view of a usual crawler crane comprising a hoisting cable drive with two hoisting winches.

FIG. 2 shows an ordinary crawler crane with two separate hoisting winches 7, 8 and two separate hoisting-cable lines 9, 10, which can be reeled on or off independently and separately from each other on the two hoisting winches 7, 8. As shown in FIG. 2, each of the two hoisting-cable lines 9, 10, starting from the two hoisting winches 7, 8, is reeved—by way of a winding roller 12, arranged on the rear of the boom 11 on the head of said boom 11, as well as by way of at least two pulleys 13, 14 arranged on the boom head—to a bottom-hook block, which could for example also be a double bottom-hook block 1. As is clear with reference to FIG. 1, for example by way of a first pulley 13 at the boom head, the first hoisting cable line 9 could be reeved to the first sheave set 3, and accordingly the second hoisting-cable line 10 could be reeved to the second sheave set 4 by way of a second pulley 14 at the boom head. In the case, for example, where the elongation of the cable of the second hoisting-cable line 10 is greater than that of the cable of the first hoisting-cable line 9, this will cause the sheave set 4 of the double bottom-hook block 1 to drop somewhat until both hoisting-cable lines 9, 10 are carrying the same loads again. However, due to the disadvantages already mentioned above, for example the considerable design height of the double bottom-hook block, the problems during reeving and slinging and putting down, as well as the general unwieldiness of the double bottom-hook block, this principle, known per se, of load equalisation by means of a double bottom-hook block has proven to be disadvantageous. These disadvantages of such double bottom-hook blocks can be avoided with the present invention, which is illustrated below.

Figure 3:
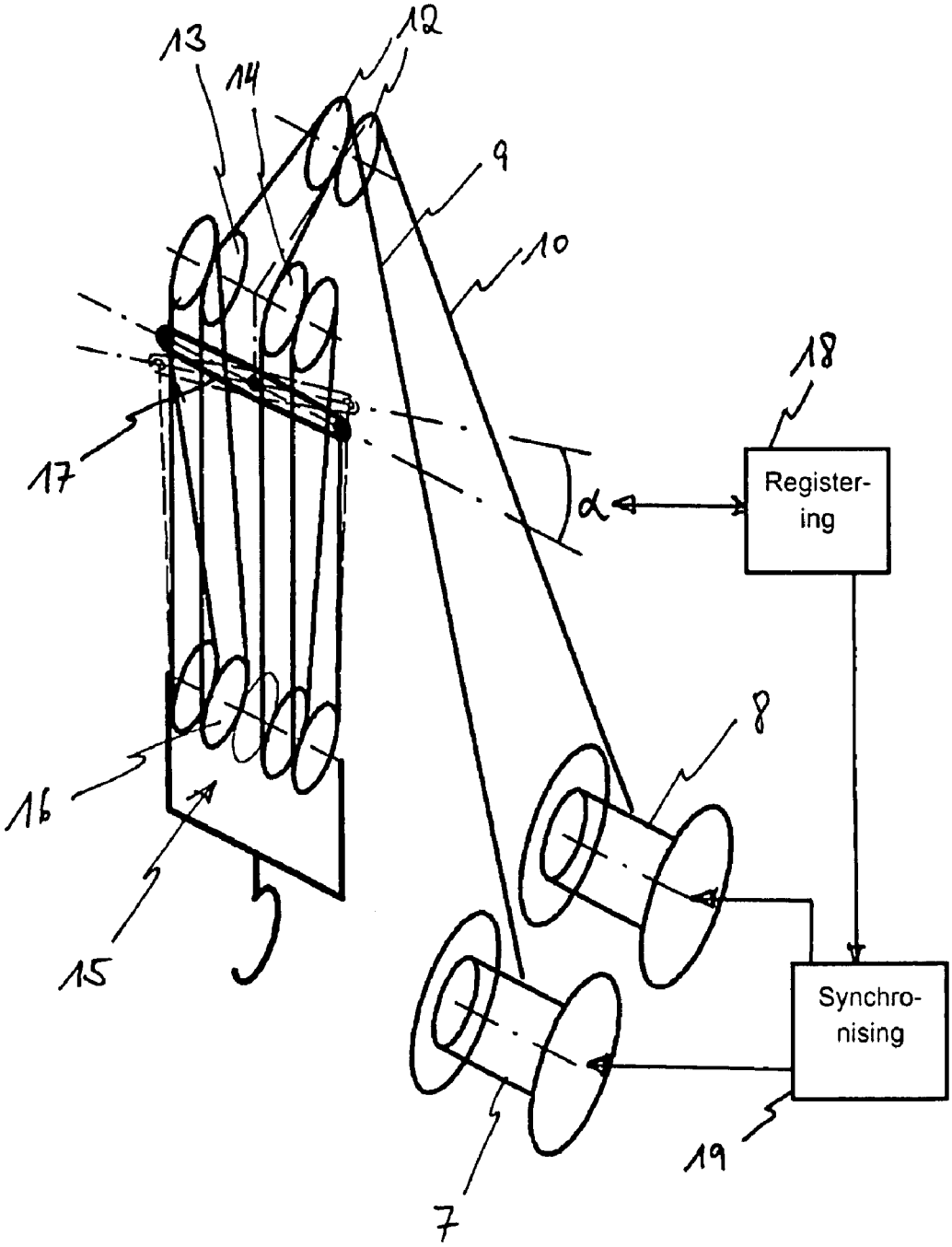
FIG. 3 shows a hoisting-cable drive according to the invention, comprising two hoisting winches and an equalising swivel.

FIG. 3 shows a perspective diagrammatic view of a hoisting-cable drive according to the invention. For the sake of clarity and simplicity, the boom 11 and further components of rather secondary importance are not shown. The hoisting-cable drive shown essentially comprises two mechanically non-synchronised hoisting winches 7, 8, two separate hoisting-cable lines 9, 10, a sheave set arranged on the boom head, which in this diagram is shown in a dot-dash line, which sheave set comprises two times two pulleys 13, 14, as well as an equalising swivel 17, arranged on the boom head, which in this diagram is shown in a dot-dash line. As is diagrammatically shown, the single bottom-hook block 15 comprises a sheave set 16 comprising four pulleys, wherein all sheaves are arranged on a uniform common axis. The single bottom-hook block 15 is thus considerably simpler in design and less heavy than the previously described double bottom-hook block 1. Moreover, the design height of said single bottom-hook block is lower than that of the double bottom-hook block 1.

As shown in the perspective view of FIG. 3, starting from one of the two hoisting winches 7, 8, each of the two hoisting-cable lines 9, 10 is reeved to the single bottom-hook block 15 by way of one of the winding rollers 12 as well as by way of two pulleys 13, 14 arranged on the boom head, from where it leads back to the equalising swivel 17, which in this embodiment is attached as a hinged lever mechanism to the boom head, which is shown in a dot-dash line. The ends of the two hoisting-cable lines 9, 10 are attached to the respective ends of the equalising swivel 17, wherein the respective ends can also be attached to another position of the equalising swivel 17, for example in order to take into account different sheave diameters or other kinematic characteristics of the hoisting-cable drive.

In the position drawn in bold outline, the equalising swivel 17 is in its home position, i.e. its legs extend at a right angle in relation to the luffing plane of the crane. Moreover, FIG. 3 shows a further position of the equalising swivel 17 in which the latter is moved out of its home position. The equalising swivel 17 takes up this moved-out position for example if the cable of the hoisting-cable drive 10 is more elongated than the cable of the hoisting-cable drive 9, or if the hoisting winch 8 is reeled off slightly faster than the hoisting winch 7. However, by the equalising swivel 17 taking up the moved-out position shown, the situation can be avoided where the single bottom-hook block 15 takes up a lopsided position so as to compensate for these differences in length. As a result of the kinematic properties of the equalising swivel it is thus not necessary to equip the shown hoisting-cable drive with the two hoisting winches 7, 8 in the known way with a double bottom-hook block. Instead, the simpler single bottom-hook block can be used, as a result of which the disadvantages of a double bottom-hook block can be avoided.

In order to ensure that the equalising swivel 17 does not exceed a maximum permissible excursion angle, the hoisting-cable drive according to the invention comprises a registering device which monitors the kinematic change in the state of the equalising swivel 17. In a case where for example the excursion angle $\alpha$ were to become excessive and thus approach a maximum permissible equalisation angle, the registering device 18 registers this and communicates the respective current excursion angle $\alpha$ to the winch synchronisation control system 19, which then by processing the registered excursion $\alpha$ adjusts the rotary speed of at least one of the two hoisting winches 7, 8 such that the length of the two cable lines between the boom head, which in this diagram is shown by a dot-dash line, and the single bottom-hook block 15 is essentially the same again.

In the example shown in FIG. 3, this would mean that for example in the case where the bottom-hook block drops, the second hoisting winch 8 would be operated slightly more slowly than the first hoisting winch 7 until the equalising swivel 17, due to the resulting change in length of the hoisting-cable lines 9 and 10, has returned to its home position.

Figure 4:
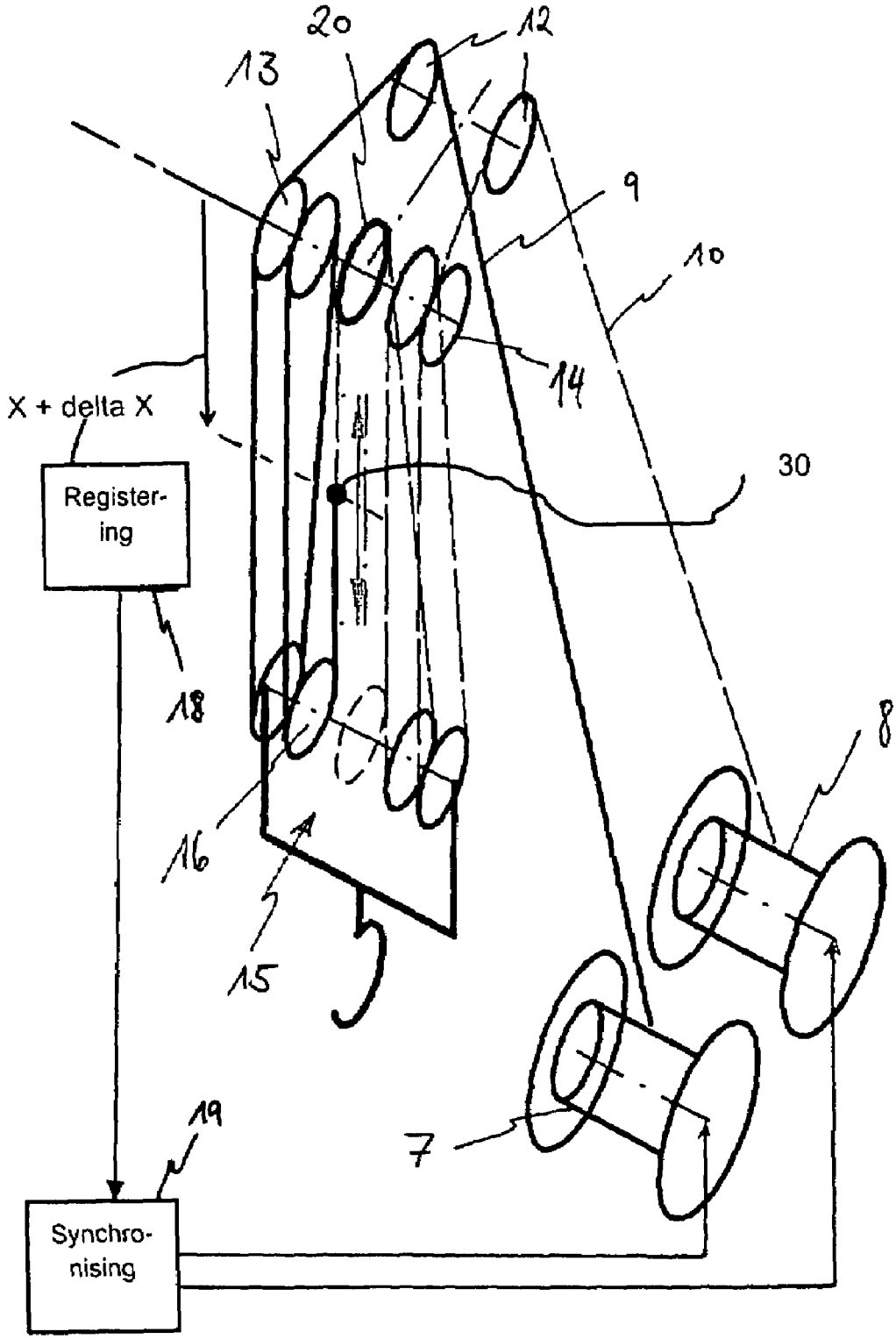
FIG. 4 shows a further hoisting-cable drive according to the invention, comprising two pulleys and an equalising roller.

FIG. 4 shows a further exemplary embodiment of the hoisting-cable drive according to the invention, wherein in relation to the basic design of the hoisting-cable drive shown reference is made to the explanations concerning the hoisting-cable drive shown in FIG. 3. The hoisting-cable drive shown in FIG. 4 essentially differs from that shown in FIG. 3 in that in the case of FIG. 4 the equalising swivel 17 has been replaced by an equalising roller 20, which in the diagram shown is integrated in the sheave set 13, 14 on the boom head, which is only indicated by a dot-dash line. As shown in FIG. 4, it is of course also possible to integrate the equalising roller in the sheave set of the single bottom-hook block 15, as shown by the dashed line of a middle sheave. Analogous to the previously described embodiment, by means of an equalising swivel 17, here too the two hoisting-cable lines 9, 10, starting from one of the two hoisting winches 7, 8, are reeved—by way of a winding roller 12, as well as by way of two pulleys 13, 14 arranged on the boom head—to the equalising roller 20, which, as will be explained below, equalises different tensile forces in the two cable lines 9, 10 by means of its kinematic design.

As shown in the diagram, the second hoisting-cable line 10 is reeved to the single bottom-hook block 15 by way of one of the winding rollers 12 as well as by way of the pulley 14 from which it leads to the equalising roller 20 which deflects this second hoisting-cable line 10 a second time before being connected to the first hoisting-cable line 9 below the equalising roller 20. This connection of the two hoisting cable lines 9, 10 is diagrammatically shown by a dot. Instead of connecting the hoisting cable made of two separate hoisting-cable lines 9, 10 by way of a joint 30 as shown, it is of course also possible to actually form the two hoisting-cable lines from one single cable only, whose respective ends are reeled up by the hoisting winches 7, 8.

If we assume that the position shown in FIG. 4 is the home position of the hoisting-cable drive according to the invention, then, in a case where for example the second hoisting-cable drive 10 becomes elongated to a greater extent or is reeled off more quickly from the second hoisting winch 8, the joint 30 of the two hoisting cable lines 9, 10 will move downward, as a result of which the difference in the elongation of the two hoisting-cable lines is equalised without the single bottom-hook block 15 tending to tilt. In order to prevent, for example due to unequal elongation of the two hoisting-cable lines, the joint 30 of the two hoisting-cable lines 9, 10 from running onto the upper sheave set arranged on the boom head or from running onto the sheave set of the single bottom-hook block, the hoisting-cable drive according to the invention comprises a registering device 18 which monitors the kinematic change in the state of the joint 30, in this case the displacement of the joint 30 in the, or against the, X direction shown, or the change in the state of the equalising roller, in that said registering device 18 for example counts the number of revolutions that the equalising roller has made. If the kinematic change in the state of the equalising roller or of the joint 30 exceeds a maximum permissible limit, the registering device 18 registers this and informs the winch synchronisation control system 19 accordingly, which then, by processing the registered kinematic change in state adjusts the rotary speed of at least one of the two hoisting winches until the length of both cable lines 9, 10 between the boom head and the single bottom-hook block 15 is the same again. In the previously mentioned example, in which for example the second hoisting-cable line has become more elongated than the first hoisting-cable line 9, in a downward movement of the single bottom-hook block 15 this would mean that during further lowering of the single bottom-hook block 15 the second hoisting winch 8 would be operated somewhat more slowly than the first hoisting winch 7. Of course it is also possible to register the kinematic change in state, and thus carry out the adjustment of the rotary speed of the winch or winches continuously so that the joint 30 between the two hoisting-cable lines 9, 10 is essentially always in its home position.

By the way, it is also possible to omit the equalising roller 20. In this case, the amount by which the joint 30 of the two cable lines 9, 10 is rising or lowering is continuously measured or measured isochronous. With other words: the deviation $\Delta X$ of the joint 30 from a reference position X is continuously measured (or measured isochronous) and the measured deviation $\Delta X$ is considered in calculating the respective rotational speed of at least one winch 7, 8. Alternatively, instead of the joint 30 any predetermined point on the cable lines 9, 10 can be monitored with respect to a lowering or rising. For example, it is possible to detect if the joint 30 or a predetermined point on one of the cable lines 9, 10 changes its position compared with a reference position. The reference position may be a point on the crane or outside the crane. Alternatively, it is e.g. possible to monitor the deviation of the joint 30 or the predetermined point on one of the cable lines 9, 10 by using a GPS system.

Figure 5:
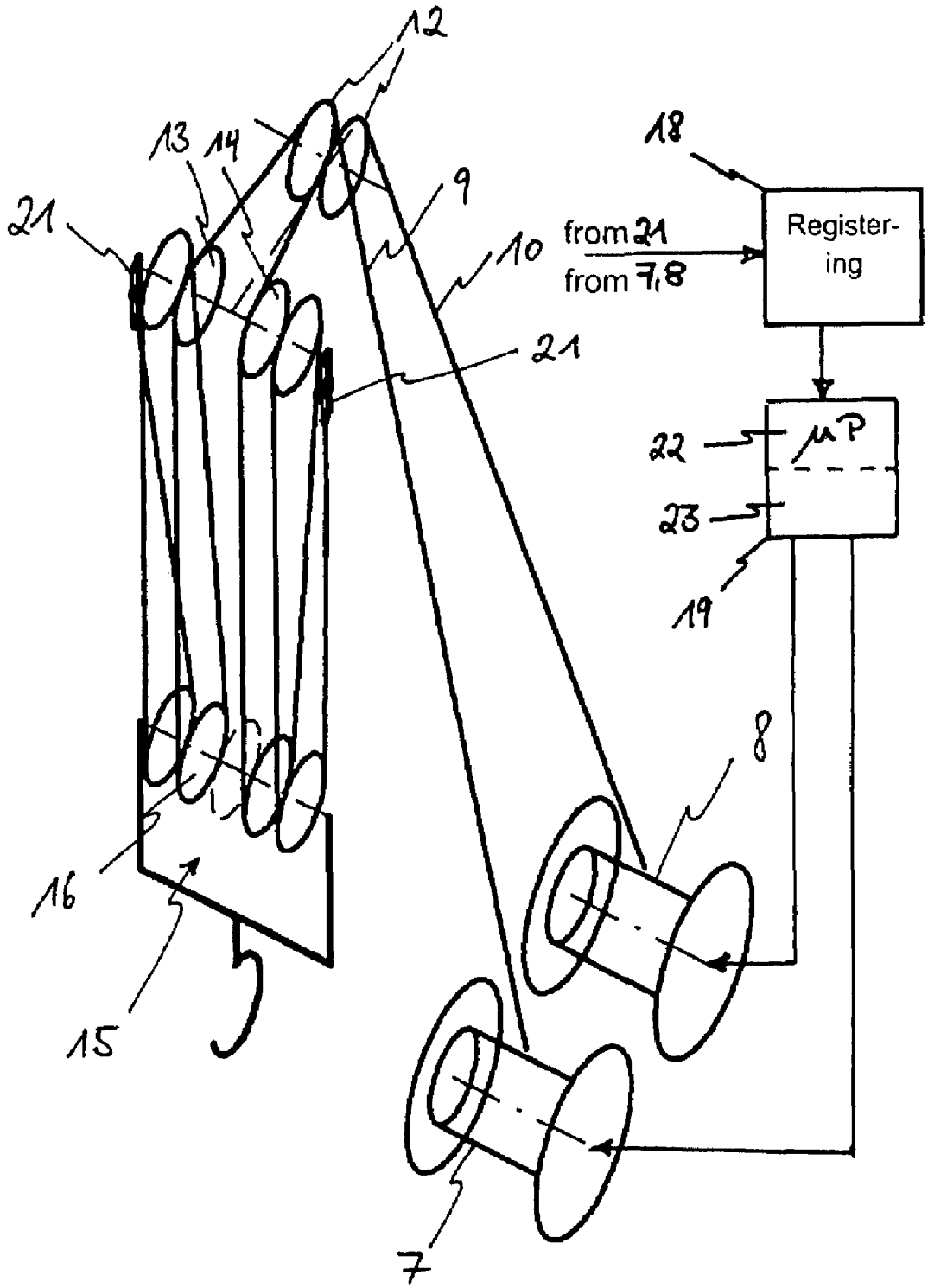
FIG. 5 shows yet another hoisting-cable drive according to the invention, comprising two hoisting winches and two hoisting-cable load pickups.

FIG. 5 shows a third embodiment of the hoisting-cable drive which basically conforms to the two previously described embodiments so that essentially reference is made to the information provided in the context of these embodiments. The hoisting-cable drive shown in FIG. 5 again comprises a single bottom-hook block 15 with a sheave set 16 comprising at least two pulleys; a sheave set arranged on the boom head, which in this diagram is shown by a dot-dash line, also comprising at least two pulleys 13, 14, two controllable hoisting winches 7, 8 and two separate hoisting-cable lines 9, 10, each of which, starting from one of the two hoisting winches 7, 8, is again reeved to the single bottom-hook block by way of one of the winding rollers 12 as well as by way of at least one of the pulleys 13, 14, of which there are at least two, arranged on the boom head. In contrast to the two previously explained embodiments of the invention, the embodiment shown in this diagram furthermore comprises at least one hoisting-cable load pickup 21 within the cable line arrangement of each hoisting-cable line 9, 10, by way of which the respective ends of the hoisting-cable lines 9, 10 are attached to the boom head or to the upper sheave set.

In a way different to the embodiment shown in FIG. 5, it is also possible to attach the ends of the respective hoisting-cable lines 9, 10 by way of a hoisting-cable load pickup 21, which can for example be a load cell, to the single bottom-hook block 15. Furthermore, it is possible to determine the tensile forces present in the respective hoisting-cable lines 9, 10 not directly by way of a hoisting-cable load pickup, but instead to measure the tensile force in the two cable lines 9, 10 indirectly by way of determining the deflection force or bearing force at a deflection position 12, 13, 14 of the respective cable lines. In the case where a difference in load between the two cable lines 9, 10 has been determined, for example by means of the two hoisting-cable load pickups 21, so that for example the tensile force in the second hoisting-cable line 10 is less than in the first hoisting-cable line 9, this difference in load can be equalised by controlling the rotary speed of the two hoisting winches 7, 8. In the example just mentioned, during lowering of the single bottom-hook block 15, this would for example mean that during further lowering of the single bottom-hook block 15, the reeling-off speed of the first hoisting winch 7 would need to be increased, or the reeling-off speed of the second hoisting winch 8 would have to be decreased. Such control can take place by way of the winch control system 18, 19 shown, which will be explained in more detail further on during the description of the figures.

In the present paragraph a modification of the third embodiment, shown in FIG. 5, of the hoisting-cable drive according to the invention is described. In a way different to the embodiment in which the rotary speed of the winch or winches is controlled by registering the hoisting cable forces, this embodiment provides for the rotary speed of at least one of the two winches 7, 8, while registering and processing the geometric winch states and equipment states of the mobile crane, to be adjusted such that the length of the two cable lines 9, 10 between the boom head and the single bottom-hook block 15 is always essentially the same. As is shown in FIG. 2, the two pulleys 7, 8 are arranged one behind the other on the superstructure of the crawler crane shown. This means that the cable length in both cable lines 9, 10 between the two winding rollers 12 and the two hoisting winches 7, 8 differs in size. These geometric relationships result in, for example during lowering of the bottom-hook block and simultaneous inclination of the boom 11, the distances between the winding rollers 12 and the hoisting winches 7, 8, which are arranged one behind the other, changing at a different rate. This in turn results in a single bottom-hook block 15 tending to tilt. In order to counter this, the respective equipment state of the crane is registered and taken into account in controlling the rotary speed of the winch or winches. The geometric winch relationships, which include in particular the current cable layer and/or the winch revolutions that have already been carried out, are a further important influence which needs to be taken into account in controlling the rotary speed of the winch or winches. For example, in the case where, at the time of observation, the first hoisting-cable line 9 of the hoisting winch 7 is reeled-off from the fifth cable layer, while the second hoisting-cable line 10 on the second hoisting winch 8 is in the third cable layer, with the same angular velocity of the two hoisting winches and the same cable drum diameter this would cause the hoisting-cable line 9 to be reeled off faster than the second hoisting-cable line 10. In order to counter this influence, during control of the winches, the current cable layer of the two hoisting winches 7, 8 is continuously monitored and taken into account in the control of the two winches 7, 8. Such monitoring of the current cable layer can for example be achieved in that the revolutions are monitored which the respective winch 7, 8 has already carried out starting from a home state.

FIG. 5 not only shows the design of the hoisting-cable drive according to the invention but also the winch control system 18, 19. The winch control system 18, 19 according to the invention comprises a registering device 18, which for example monitors and registers the hoisting-cable load pickups 21 and/or the geometric relationships of the two hoisting winches 7, 8 and furthermore also the equipment states of the crane. The force and/or distance values acquired and registered in this way, as well as for example the registered winch revolutions, are transmitted from the registering device to the winch synchronisation control system 19 which comprises a processing device 22, for example in the form of a microprocessor, and a control device 23. The processing device 22 further processes the state variables determined by the registering device 18 and supplies a control signal to the control device 23, in particular taking into account any manually specified winch speed, wherein the control device 23 then, depending on the processing results, adjusts the rotary speed of at least one of the two hoisting winches 7, 8 such that the length of the two cable lines 7, 8 between the two sheaves 17 is always essentially identical.

As can be seen from the above description, the winch control system according to the invention is not only suitable for the hoisting-cable drive of a crane with two hoisting winches, but also for any cable drive operated with two separate winches.

Figure 6:
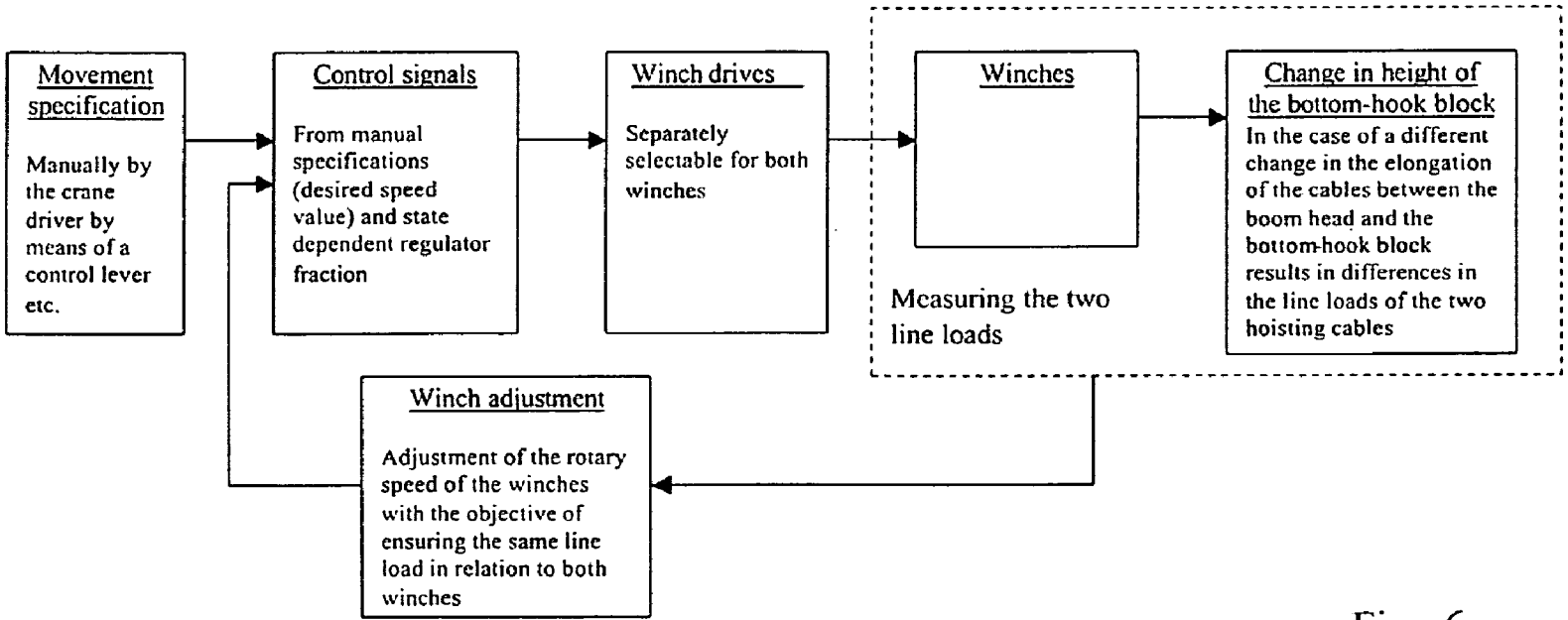
FIG. 6 shows a diagram explaining the winch control system according to the invention.
Figure 7:
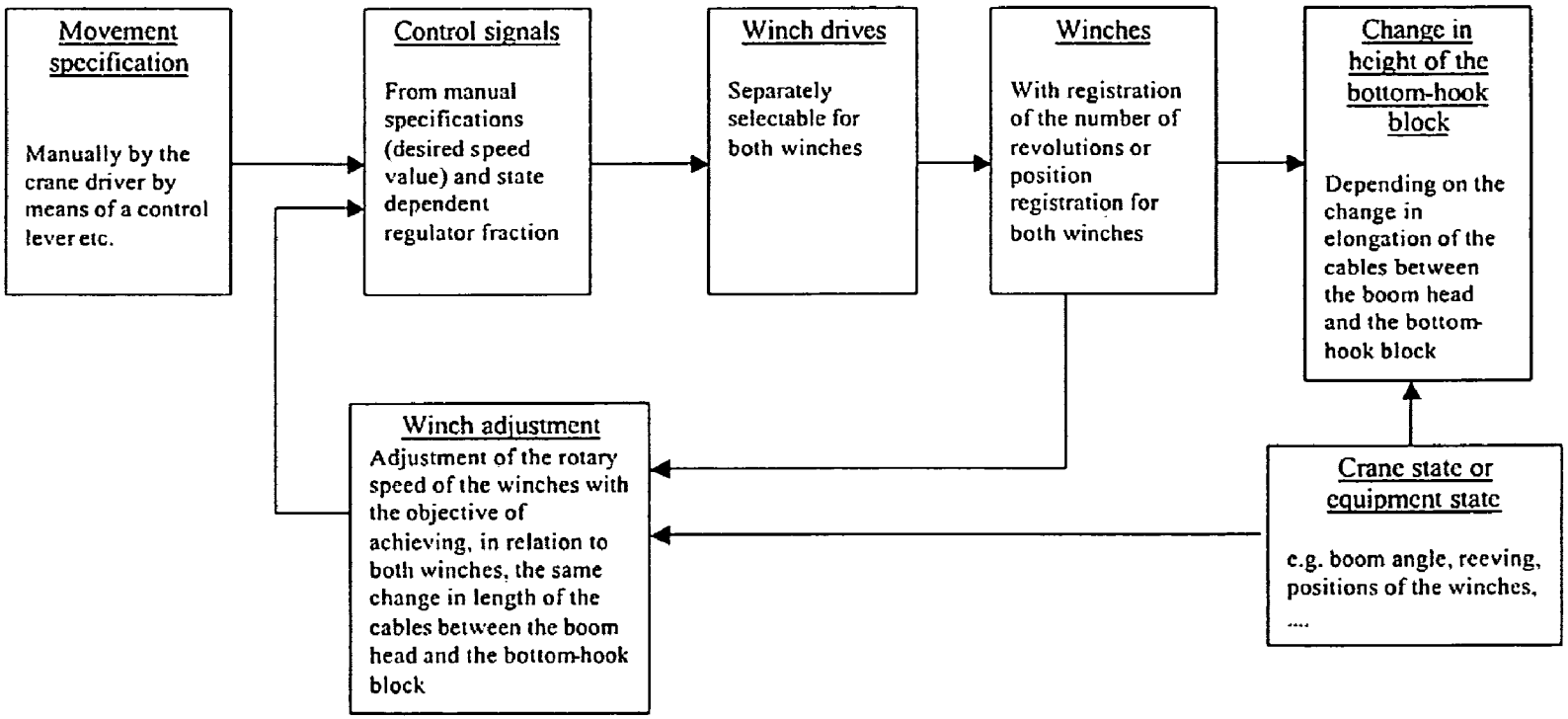
FIG. 7 shows a further diagram explaining another embodiment of the winch control system according to the invention.

In FIGS. 6 and 7 the winch control system is again explained in more detail. The diagram of FIG. 6 shows a manual and an automated control line. The manual control line comprises the chain formed in the first line by the five control blocks. The winch control system according to the invention intervenes in a controlling way in this manual control line, as indicated by the winch control block shown in the second line. The manual control line is initiated by a movement specification by which a crane driver operates the two hoisting winches 7, 8 together or independently of each other, for example by activating a control lever. As shown in the second block, this activation triggers control signals which are transmitted to the two winch drives so that the two winches start to move. This in turn leads to the bottom-hook block being lowered or raised. If load differences in the two cable lines 9, 10 occur, which load differences—as indicated by the dashed block—can be measured by measuring on the winches or on the cable drive itself by means of a registering device 18, then with the use of the winch synchronisation control system according to the invention, which in this diagram is shown in the second line in the automated control line as winch adjustment 19, the rotary speed of the respective hoisting winches 7, 8 can be adjusted so that the line load in both hoisting-cable lines 9, 10 is identical again. This is achieved in that the winch synchronisation control system 19 influences the manually specified control signals, which as a result comprise a manually specified desired value and a state-dependent control component.

With reference to FIG. 7, the winch control system is now described, which, taking into account the geometric winch relationships and the equipment states of the crane, handles control of the rotary speed of the winches. Analogous to FIG. 6, here too the five blocks arranged in the first line represent the manual control line of the hoisting-cable drive according to the invention, wherein winch control is initiated by manual movement specifications by the crane driver. These manual movement specifications again trigger control signals, as a result of which the drives of the two hoisting winches 7, 8 are controlled separately, and the hoisting winches 7, 8 are thus moved independently of each other. This in turn leads to a change in height of the bottom-hook block. As indicated in the diagram by reference number 18, by means of a registering device 18 the geometric winch states and equipment states of the crane, such as for example the winch revolutions that have already been carried out, the respective current cable layer, the angle of the boom, the reeving, the position of the winches and other influences which can affect the rotary speed of the winches are registered. These values that have been determined by means of the registering device 18 are communicated to the winch control system 19, which by processing the communicated crane values and winch values influences the manually specified control signals such that by adjusting the rotary speed of both hoisting winches 7, 8, the same change in length of the cable lines between the boom head and the bottom-hook block can be achieved again.

Figure 8:
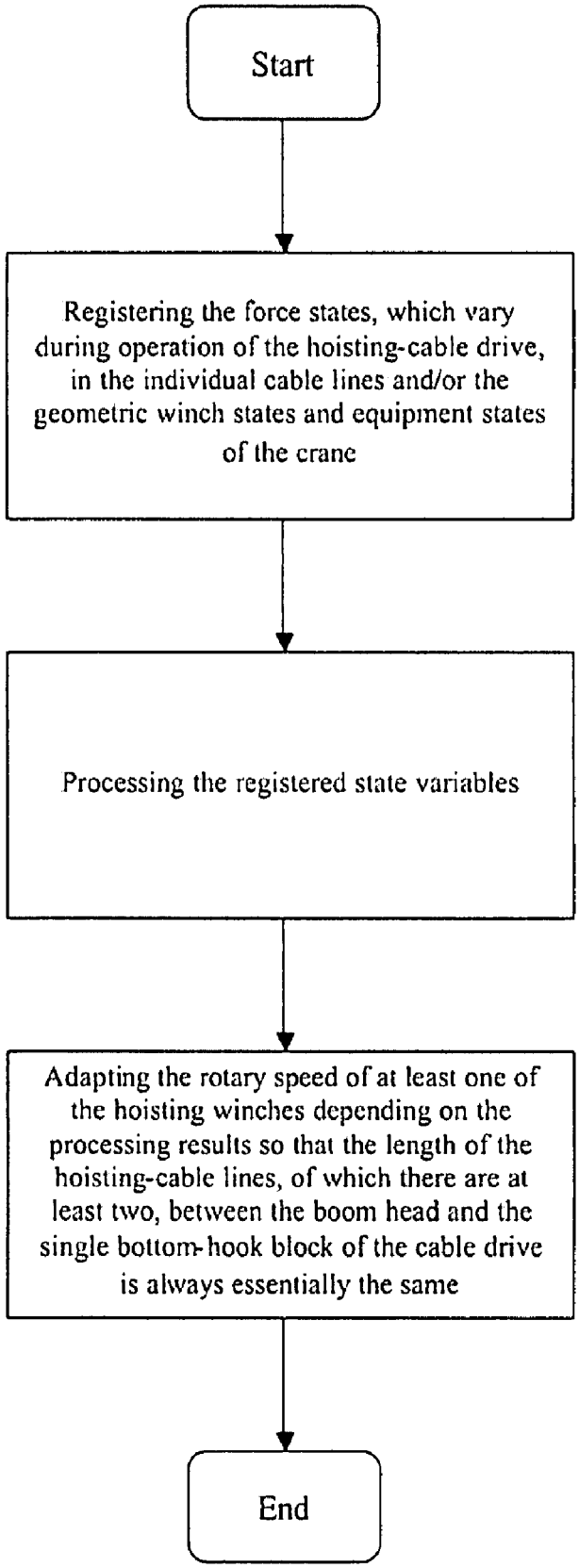
FIG. 8 shows a flow chart explaining the synchronisation method according to the invention.

Finally, with reference to FIG. 8 the synchronisation method, according to the invention, for the hoisting-cable drive of a crane is to be explained. The synchronisation method according to the invention is particularly suited to a crane with a single bottom-hook block 15 with a sheave set 16 that comprises at least two pulleys 7, a sheave set arranged on the boom head of the crane, which sheave set also comprises at least two side sheaves 13, 14, two controllable hoisting winches 7, 8 and two separate hoisting-cable lines 9, 10, each of which, starting from one of the two hoisting winches 7, 8, is reeved in by way of one of the pulleys, of which there are at least two, arranged on the boom head. The method according to the invention in a first step registers the varying force states in the individual hoisting-cable lines 9, 10 and/or the geometric winch states and equipment states of the crane, which states vary during operation of the hoisting-cable drive. In a further step these state variables registered in this way are processed for example by a microprocessor which then, by influencing the control signals that for example have been manually specified by a crane driver, changes these state variables so as to in this way adjust the rotary speed of at least one of the hoisting winches 7, 8 depending on the processing results of the microprocessor 22 so that the length of the hoisting-cable lines 9, 10, of which there are at least two, between the boom head and the single bottom-hook block 15 of the cable drive is always essentially the same.

As has already been explained in the above description of the figures, registering can take place in the first step of the method, in that the tensile force is directly measured in the hoisting-cable lines 8, 10, of which there are at least two. As an alternative to this it is also possible to register the tensile force of the hoisting cable in that the tensile force in the hoisting-cable lines 9, 10, of which there are at least two, is measured indirectly by way of determining the deflection forces or bearing forces at a deflection position of the respective cable lines 9, 10.

Of course it is also possible to combine the individual embodiments of the present invention. Thus, it is for example possible to combine a hoisting-cable drive comprising an equalising swivel with at least one hoisting-cable load pickup 21 within the cable line arrangement of each hoisting-cable line 9, 10, or to combine it with the winch control system 18, 19 according to the invention. The individual embodiments of the present invention can thus be combined in any desired manner in order to achieve an optimum synchronisation result.

The invention claimed is:

1. A hoisting-cable drive for a mobile crane having a boom with a boom head, comprising:

a single bottom-hook block with a first sheave set that has at least two pulleys;

a second sheave set arranged on the boom head of the mobile crane, which second sheave set comprises at least two pulleys;

two mechanically non-synchronised hoisting winches;

two separate hoisting-cable lines;

a detection device adapted to continuously detect a deviation of a predetermined point on one of the hoisting-cable lines from a reference position; and, a control device coupled to the detection device and the two hoisting winches, wherein the control device is adapted to calculate a rotating speed and/or rotating direction of at least one of the winches on a basis of the continuously detected deviation of the predetermined point from the reference position such that the predetermined point resumes the reference position.

2. The hoisting-cable drive according to claim 1, wherein the predetermined point is located on a joint of the two hoisting-cable lines.

3. The hoisting-cable drive according to claim 1, wherein an equalizing roller is provided by way of which one of the hoisting-cable lines is defected and then conveyed to the other hoisting-cable line.

4. The hoisting-cable drive according to claim 1, wherein an equalizing roller is integrated in the first sheave set of the single bottom-hook block or in the second sheave set on the boom head.

5. The hoisting-cable drive according to claim 1, wherein the two hoisting-cable lines are integrated into a single hoisting-cable.

6. The hoisting-cable drive according to claim 1, wherein a GPS system monitors the deviation of the predetermined point.

7. A synchronization method for a hoisting-cable drive of a crane having a boom and a boom head, which hoisting-cable drive comprises a single bottom-hook block with a first sheave set comprising at least two pulleys; a second sheave set arranged on the boom head of the crane, which second sheave set comprises at least two pulleys; two controllable, mechanically non-synchronized hoisting winches; and, two separate hoisting-cable lines which are reeved to the single bottom-hook block starting from one of the two hoisting winches by way of one of the at least two pulleys, arranged on the boom head; said method comprising the steps of:

continuously detecting a deviation of a predetermined point on one of the cable lines from a reference position during operation of the hoisting cable drive; and, calculating a rotating speed and/or rotating direction of at least one of the winches on a basis of the continuously detected deviation of the predetermined point from the reference position such that the predetermined point resumes the reference position.

* * * * *